US006729937B2

(12) United States Patent
Kawasaki

(10) Patent No.: US 6,729,937 B2
(45) Date of Patent: May 4, 2004

(54) BARREL-POLISHING APPARATUS

(76) Inventor: Shuji Kawasaki, 1431, Nakatajima-cho, Hamamatsu-shi, Shizuoka-ken 430 (JP)

( * ) Notice: Subject to any disclaimer, the term of this patent is extended or adjusted under 35 U.S.C. 154(b) by 294 days.

(21) Appl. No.: 09/790,844

(22) Filed: Feb. 22, 2001

(65) Prior Publication Data

US 2001/0007811 A1 Jul. 12, 2001

Related U.S. Application Data

(63) Continuation of application No. 09/206,457, filed on Dec. 7, 1998, now Pat. No. 6,280,303.

(30) Foreign Application Priority Data

| | | |
|---|---|---|
| Dec. 10, 1997 | (JP) | 9-361905 |
| Feb. 4, 1998 | (JP) | 10-61869 |
| Jun. 28, 1998 | (JP) | 10-198037 |
| Aug. 30, 1998 | (JP) | 10-260880 |
| Nov. 10, 1998 | (JP) | 10-319598 |

(51) Int. Cl.[7] ..... B24B 49/00; B24B 51/00; B24B 7/00

(52) U.S. Cl. ..... 451/10; 451/104; 451/113; 451/170; 451/910

(58) Field of Search ..... 451/5, 8, 104, 451/105, 106, 107, 113, 170, 171, 174, 175, 910, 10

(56) References Cited

U.S. PATENT DOCUMENTS

| | | | | | |
|---|---|---|---|---|---|
| 3,380,195 | A | * | 4/1968 | Bodine, Jr. | 451/113 |
| 3,581,440 | A | * | 6/1971 | McKinney et al. | 451/113 |
| 3,589,071 | A | * | 6/1971 | Hirschhorn | 451/36 |
| 3,623,278 | A | * | 11/1971 | Schwartz | 451/32 |
| 4,205,487 | A | * | 6/1980 | Anderson et al. | 451/113 |
| 5,125,191 | A | * | 6/1992 | Rhoades | 451/36 |
| 5,150,548 | A | * | 9/1992 | Boquet et al. | 451/32 |
| 5,449,313 | A | * | 9/1995 | Kordonsky et al. | 451/35 |
| 5,857,901 | A | * | 1/1999 | LaPoint | 451/113 |

* cited by examiner

*Primary Examiner*—Timothy V. Eley
(74) *Attorney, Agent, or Firm*—Muramatsu & Associates

(57) ABSTRACT

There is disclosed a barrel-polishing apparatus comprising a polishing medium bath with polishing mediums received therein, a base, an arm mounted on the base, and a workpiece attachment device mounted on a distal end portion of the arm and adapted to attach a workpiece to the arm, wherein the polishing mediums are caused to flow within the polishing medium bath by an appropriate device and a pressing plate for pressing the polishing mediums is mounted on the polishing medium bath. A barrel-polishing method is also disclosed.

6 Claims, 16 Drawing Sheets

BARREL-POLISHING APPARATUS

This is a continuation of U.S. patent application Ser. No. 09/206,457 filed Dec. 7, 1998 now U.S. Pat. No. 6,280,303.

1. Field of the Invention

This invention relates to a barrel-polishing apparatus and a barrel-polishing method.

2. Prior Art (First Prior Art and Shortcomings Thereof)

In conventional barrel-polishing apparatuses, it is a usual practice that a workpiece is polished while flowing polishing mediums or while vibrating a workpiece in stationary polishing mediums.

However, because of the reasons that the polishing mediums tend to bulge over the workpiece due to flow of the polishing mediums in the former polishing apparatus and due to flow of the polishing mediums caused by vibrations of the workpiece in the latter polishing apparatus, a surface pressure of the polishing mediums applicable to the workpiece is readily reduced to discourage the enhancement of the polishing efficiency.

(Second Prior Art and Shortcomings Thereof)

Conventionally, there is known a typical method for polishing a workpiece. In this method, a workpiece is placed in polishing mediums such that an upper end side of a surface-to-be-polished of the workpiece is slanted forwardly and the workpiece is polished by rotating the workpiece in a circumferential direction while flowing the polishing mediums relative to the workpiece.

However this conventional barrel-polishing method has such shortcomings that in case the workpiece has a hole around its axis, the polishing mediums readily pass through the hole when they flow along the workpiece and therefore, they hardly stay at the axial portion of the workpiece, with the result that the axial portion of the workpiece is left unpolished.

(Third Prior Art and Shortcomings Thereof)

In the conventional barrel-polishing apparatus, it is a usual practice that a workpiece is polished while flowing the polishing mediums.

However, this conventional barrel-polishing apparatus has such shortcomings that since the entire polishing mediums must be flowed in order to flow the polishing mediums, the apparatus itself inevitably becomes large scale.

(Fourth Prior Art and Shortcomings Thereof)

If the workpiece is polished while rotating the workpiece in the polishing mediums, the polishing mediums are worn. Therefore, in the conventional apparatus, when the aggregate of polishing mediums has been partly worn, the workpiece is moved in the polishing medium bath in an effort to find a non-worn part of the polishing mediums and dipped in the non-worn part of the polishing mediums. By keep doing so in the polishing operation, a certain polishing effect can be obtained.

However, in such a conventional polishing apparatus, since the partial wear of the aggregate of polishing mediums is determined based on the perception or experience of the operator, much labor is required. In addition, since the result of determination is different depending on each operator, a constant polishing effect is difficult to obtain in an efficient manner.

OBJECTS OF THE INVENTION

It is the first object of the present invention to provide, in order to obviate the shortcomings inherent in the first prior art, a barrel-polishing apparatus having flowing polishing mediums, wherein a pressure level of polishing mediums applicable to a workpiece is maintained to a predetermined value or larger by preventing the polishing mediums from bulging, thereby enhancing the polishing efficiency of the barrel-polishing operation (hereinafter referred to the "first and second inventions").

It is the second object of the present invention to provide, in order to obviate the shortcomings inherent in the second prior art, a barrel-polishing method, wherein polishing mediums are primarily stayed at an axial portion of the workpiece so that a peripheral edge portion and the axial portion of the circumferentially rotating workpiece can be polished efficiently and positively (hereinafter referred to the "third to fifth inventions").

It is the third object of the present invention to provide, in order to obviate the shortcomings inherent in the third prior art, a barrel-polishing apparatus, which is simple in structure and easy in maintenance (hereinafter referred to the "sixth and seventh inventions").

It is the fourth object of the present invention to provide, in order to obviate the shortcomings inherent in the fourth prior art, a barrel-polishing apparatus, wherein a constant polishing effect can normally be obtained efficiently and automatically even in case an aggregate of the polishing mediums is partly worn (hereinafter referred to the "eighth invention").

(Construction of the Invention and Operation and Effects Thereof)

A barrel-polishing apparatus according to the first invention comprises a polishing medium bath with polishing mediums received therein, a base, an arm mounted on the base, and a workpiece attachment device mounted on a distal end portion of the arm and adapted to attach a workpiece to the arm, wherein the polishing mediums are caused to flow within the polishing medium bath by appropriate means and a pressing plate for pressing the polishing mediums is mounted on the polishing medium bath. Accordingly, since the polishing mediums are prevented from bulging by this pressing plate, a pressure level of the polishing mediums applicable to the workpiece can easily be maintained to a predetermined value or larger in the barrel-polishing apparatus having flowing polishing mediums. Thus, with use of this barrel-polishing apparatus, the polishing efficiency of the barrel-polishing operation can easily be enhanced in the barrel-polishing apparatus having flowing polishing mediums.

Also, as in the barrel-polishing apparatus according to the second invention, if there are further employed vibration means for vibrating the arm and a pressing plate for pressing the polishing mediums, mounted on the polishing medium bath, the polishing mediums are prevented from bulging by this pressing plate. Accordingly, a pressure level of the polishing mediums applicable to the workpiece can easily be maintained to a predetermined value or larger in the barrel-polishing apparatus having a vibrating workpiece. Thus, with use of this barrel-polishing apparatus, the polishing efficiency of the barrel-polishing operation can easily be enhanced in the barrel-polishing apparatus having a vibrating workpiece. If the pressing plate is fixed to the base and the polishing medium bath is moved reciprocally in a direction of the work attachment device by reciprocal means, or if the pressing plate is fixed to the base and the pressing plate is pressed in a direction of the polishing medium bath by pressing means, a pressure of the pressing plate applicable to the polishing mediums can be adjusted. Accordingly, a surface pressure of the polishing mediums applicable to the workpiece can be adjusted appropriately.

Also, if the pressing plate is divided into a plurality of auxiliary pressing plates and a pressing state of each of the auxiliary pressing plates is adjustable, a surface pressure of the polishing mediums applicable to a surface-to-be-polished of a single workpiece can partly be adjusted.

Also, if the arm is swung about the base with respect to an inner wall surface or an inner bottom wall surface of the polishing medium bath by swing means such that the arm can be fixed at an appropriate location, the surface pressure of the polishing mediums applicable to the workpiece can be adjusted by varying the flow rate of the polishing mediums relative to the workpiece.

Also, if the arm is axially reciprocally moved by reciprocal means so that the arm can be fixed at an appropriate location, the depth of the workpiece with respect to the polishing mediums can be adjusted. Thus, the surface pressure of the polishing mediums applicable to the workpiece can be adjusted.

Also, a barrel-polishing apparatus according to the third invention comprises a polishing medium bath with polishing mediums received therein, a base, an arm mounted on the base, a workpiece attachment device mounted on a distal end portion of the arm and adapted to attach a workpiece to the arm, and a pressing plate mounted on the polishing medium bath and adapted to press the polishing mediums, the polishing mediums being flowed relative to the workpiece within the polishing medium bath, wherein the pressing plate is disposed at an upper portion of the workpiece with an appropriate space therebetween. Accordingly, since the polishing mediums are prevented from bulging at its area above the workpiece by the pressing plate, the surface pressure of the polishing mediums applicable to the workpiece can be maintained at a level of a predetermined value or larger. Thus, with use of this barrel-polishing apparatus, the polishing efficiency of the barrel-polishing operation can easily be enhanced in the barrel-polishing apparatus having flowing polishing mediums.

If the pressing plate is provided with a recess so that an upper portion of the workpiece is surrounded by the recess with an appropriate space therebetween, the polishing mediums can be prevented from escaping sidewardly of the workpiece. Therefore, the surface pressure of the polishing mediums applicable to an upper surface and a side surface of the workpiece can be prevented from escaping, thereby the surface pressure can easily be maintained at a level of a predetermined value or larger. In addition, since the flow of the polishing mediums relative to the workpiece can be straightened, the workpiece can easily be rubbed. As a consequence, the workpiece can be polished in a satisfactory manner.

Also, if, in this barrel-polishing apparatus, a guide plate is connected to that end edge of the pressing plate located on an upstream side of the polishing mediums, and the guide plate is slanted towards the upstream side of the polishing mediums in an opposite direction to the workpiece, the polishing mediums can easily be gathered to the inner side of the pressing plate.

If, in this barrel-polishing apparatus, the pressing plate is fixed to the base and the polishing medium bath is reciprocally moved in a direction of the workpiece attachment device by reciprocal means, or if the pressing plate is mounted on the base and the pressing plate is pressed in a direction of the polishing medium bath by pressing means, the pressure of the pressing plate applicable to the polishing mediums can be adjusted. Thus, the surface pressure of the polishing mediums applicable to the workpiece can appropriately be adjusted.

Also, a barrel-polishing apparatus according to the fourth invention comprises a polishing medium bath with polishing mediums received therein, a base, an arm mounted on the base, a workpiece attachment device mounted on a distal end portion of the arm and adapted to attach a workpiece to the arm, and a pressing plate mounted on the polishing medium bath and adapted to press the polishing mediums, the polishing mediums being flowed relative to the workpiece within the polishing medium bath, wherein the pressing plate is disposed at an upper portion of the workpiece with an appropriate space therebetween, and a baffle plate is connected to a distal end side of the pressing plate in such a manner as to cover the workpiece. Accordingly, the polishing mediums collided against and raised along the surface-to-be-polished of the workpiece invade into a space surrounded by the pressing plate and the baffle plate and causes a turbulent flow involving the vicinity of the surface-to-be-polished of the workpiece. Accordingly, the polishing efficiency with respect to the workpiece is enhanced.

Also, in a barrel-polishing apparatus in which a workpiece is disposed in polishing mediums such that the workpiece can be rotated in a circumferential direction, an upper end portion of a surface-to-be-polished of the workpiece facing a relative flowing direction of the polishing mediums is slanted forwardly and the workpiece is polished while flowing the polishing mediums relative to the workpiece, a barrel-polishing method according to the fifth invention comprises the step of adjusting the flowing speed of the polishing mediums relative to the workpiece. Accordingly, the polishing mediums can be primarily stayed at the axial portion of the workpiece by reducing the relative flow rate of the polishing mediums. Thus, with use of this barrel-polishing method, the peripheral edge portion and the axial portion of the circumferentially rotating workpiece can be polished efficiently and positively.

If the flowing of the polishing mediums relative to the workpiece is stopped in accordance with necessity, the polishing mediums can be primarily stayed more positively. Thus, the axial portion of the workpiece can be polished more efficiently.

Also, if the flowing of the polishing mediums relative to the workpiece is stopped at the first or last stage of a polishing operation, an arrangement of the polishing operation becomes easy and therefore, the efficiency of the polishing operation is enhanced.

The relative flow of the polishing mediums with respect to the workpiece includes a method for flowing the polishing mediums and a method for moving the workpiece.

Also, a barrel-polishing apparatus according to the sixth invention comprises a polishing medium bath with polishing mediums received therein, a base, rotational drive means mounted on the base, a rotary shaft mounted on the rotational drive means, and a workpiece attachment device mounted on a distal end portion of the rotary shaft and adapted to attach a workpiece to the rotary shaft, wherein the barrel-polishing apparatus further comprises vibration means, and the rotary shaft is circularly vibrated by the vibration means along a plane including an axis of the rotary shaft. Accordingly, the polishing mediums can be moved into and out of the recess of the workpiece even in the state that the polishing mediums are stopped. Therefore, with use of this barrel-polishing apparatus, it becomes only needed to vibrate the rotary shaft instead of flowing the polishing mediums. Thus, the polishing apparatus itself is simplified in structure and its maintenance becomes easy.

As shown in a barrel-polishing apparatus according to the seventh invention, instead of vibrating circularly, the rotary shaft may be vibrated forwardly and backwardly, leftwardly and rightwardly.

Also, if a slide plate is mounted on the base such that the slide plate is reciprocally moved in a direction of the polishing medium bath by reciprocal means and the rotational drive means is mounted on the slide plate, the rotary shaft and thus the workpiece can be vibrated circularly, or forwardly and backwardly, and leftwardly and rightwardly. Since the polishing mediums can be more easily moved into and out of the recess of the workpiece, the polishing efficiency with respect to the workpiece is more enhanced.

Also, a barrel-polishing apparatus according to the eighth invention comprises a polishing medium bath with polishing mediums received therein, a base, a slide plate mounted on the base such that the slide plate is reciprocally moved in a direction of the polishing medium bath by reciprocal means, an electrically-operated rotational drive means mounted on the slide plate, a rotary shaft mounted on the electrically-operated rotational drive means and extending in a direction of reciprocal movement of the slide plate, and a workpiece attachment device mounted on a distal end portion of the rotary shaft and adapted to attach a workpiece to the rotary shaft, wherein the barrel-polishing apparatus further comprises a control unit for controlling a reciprocal movement of the reciprocal means by detecting an electric current supplied to the electrically-operated rotational drive means. Accordingly, when the rotary torque of the workpiece in the polishing mediums is reduced to reduce the electric current supplied to the electrically-operated rotational drive means, the workpiece can be moved in the polishing mediums in such a manner as to increase the rotary torque. On the other hand, when the rotary torque of the workpiece in the polishing mediums is increased to increase the electric current supplied to the electrically-operated rotational drive means, the workpiece can be moved in the polishing mediums in such a manner as to reduce the rotary torque. Therefore, with use of this barrel-polishing apparatus, a constant rotary torque can normally be obtained even if the aggregate of polishing mediums is partly worn. Thus, a constant polishing effect can be obtained efficiently and automatically.

If the slide plate is moved towards the polishing medium bath when the electric current supplied to the electrically-operated rotational drive means is smaller than a reference electric current and the slide plate is moved away from the polishing medium bath when the electric current supplied to the electrically-operated rotational drive means is larger than the reference electric current, the workpiece can easily be moved in the less-worn polishing mediums when the rotary torque is reduced and the workpiece can easily be moved in the more-worn polishing mediums when the rotary torque is increased.

Also, if the base is slanted downwardly towards the polishing medium bath, the workpiece can easily be moved reciprocally with respect to the polishing medium bath.

BRIEF DESCRIPTION OF THE DRAWINGS

FIGS. 1 to 9 show embodiments of the first and second inventions wherein:

FIG. 1 is a perspective view of a barrel-polishing apparatus according to the present invention;

FIG. 2 is a perspective view of the barrel-polishing apparatus with a workpiece removably attached thereto;

FIG. 3 is a sectional view taken on line III—III of FIG. 1;

FIG. 4 is an illustration when viewed in a direction as indicated by an arrow IV of FIG. 3;

FIG. 5 is an explanatory view showing a rotary mechanism of an inverting plate employed in the barrel-polishing apparatus;

FIG. 6 is an illustration for explaining the location of a pressing plate and a flowing direction of a polishing medium;

FIG. 7 is another illustration for explaining the location of a pressing plate and a flowing direction of a polishing medium;

FIG. 8 is another embodiment in which the pressing force of the pressing plate is adjustable; and FIG. 9 is a view of another embodiment corresponding to FIG. 3.

FIGS. 10 to 17 show embodiments of the third to fifth inventions, wherein:

FIG. 10 is a perspective view of a barrel-polishing apparatus according to the present invention;

FIG. 11 is a perspective view of the barrel-polishing apparatus with a workpiece removably attached thereto;

FIG. 12 is a sectional view taken on line X—X of FIG. 10;

FIG. 13 is a perspective view of a pressing plate of FIG. 12;

FIG. 14 is a perspective view of another embodiment of the pressing plate;

FIG. 15 is an illustration for explaining the location of the pressing plate with respect to a workpiece;

FIG. 16 is an illustration of another embodiment of the pressing plate corresponding to FIG. 14; and FIG. 17 is a sectional view taken on line XVII—XVII of FIG. 16.

FIGS. 18 and 19 show embodiments of the sixth and seventh inventions, wherein:

FIG. 18 is a front view of a barrel-polishing apparatus according to the present invention; and FIG. 19 is a sectional view taken on line XIX—XIX of FIG. 18.

EMBODIMENTS (Embodiments of the First and Second Inventions)

Figure 1:
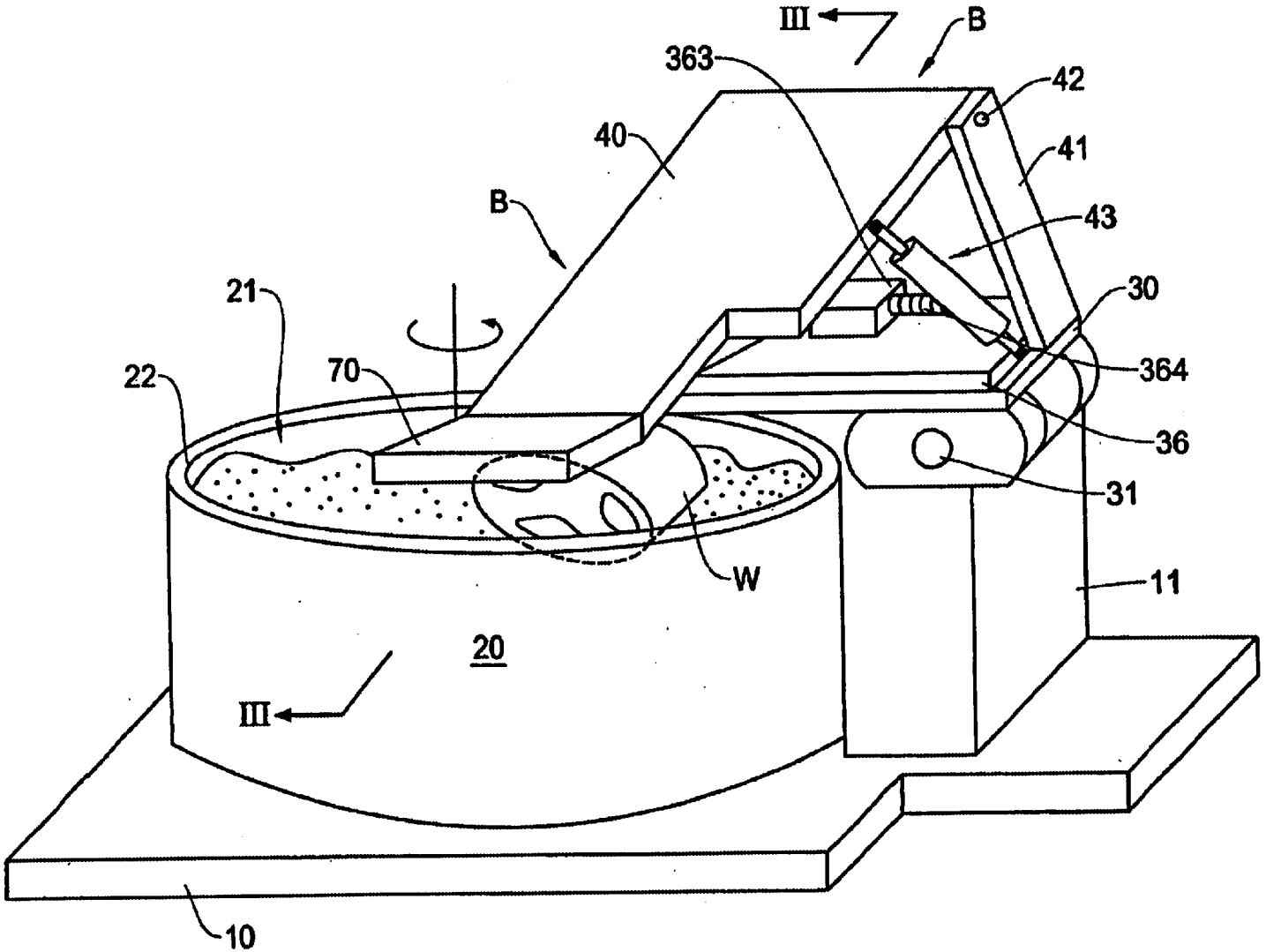
Figure 2:
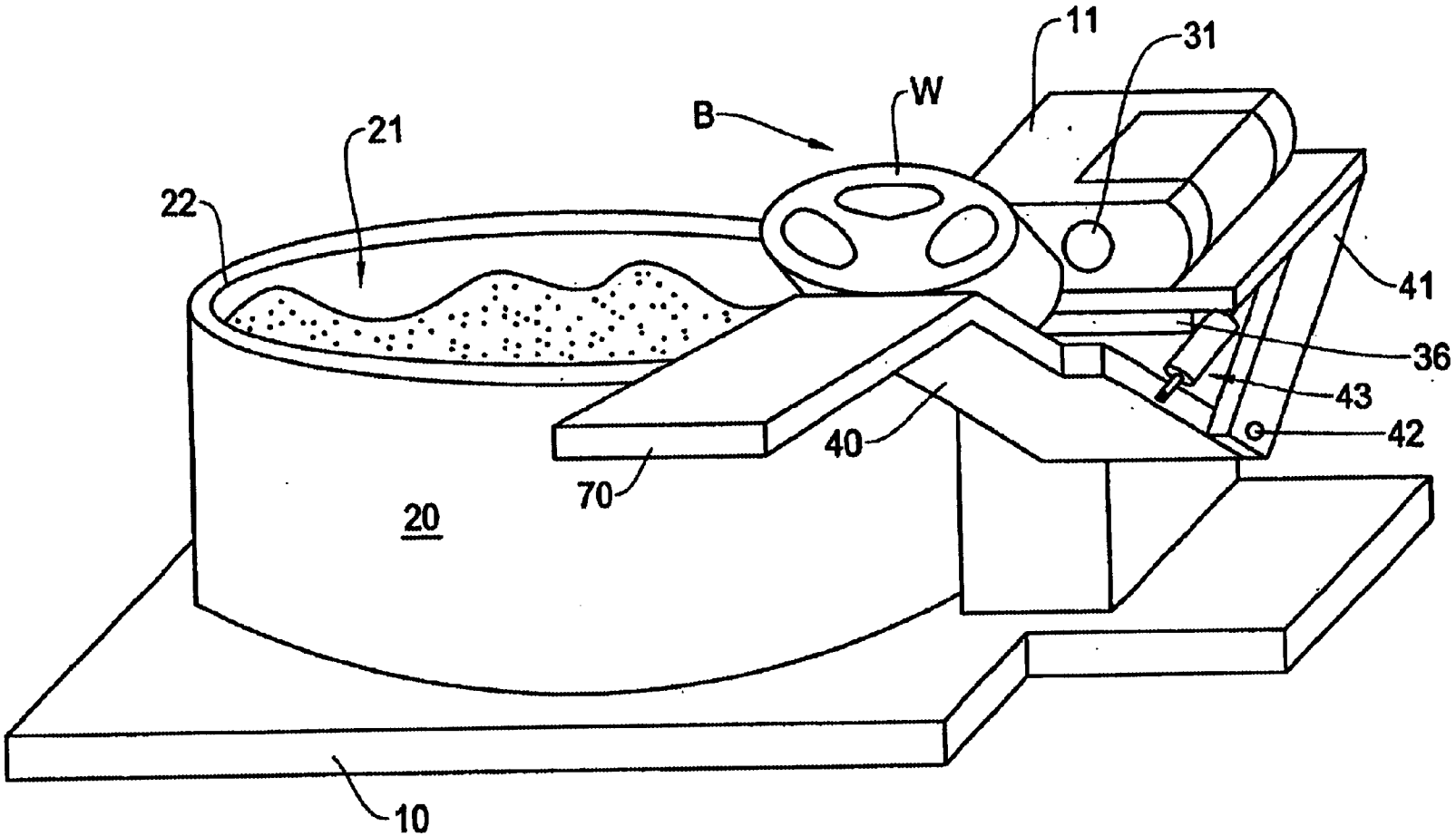

In FIGS. 1 and 2, reference character B denotes a barrel-polishing apparatus and reference numeral 10 denotes its base. Reference numeral 20 denotes a polishing medium bath which is placed on the base 10. The polishing medium bath 20 is of a cylindrical configuration. This polishing medium bath 20 can be rotated circumferentially about an axis by suitable driving means. Reference numerals 21, 21, . . . denote polishing mediums which are received in the polishing medium bath 20. Those polishing mediums 21, 21, . . . are also rotated circumferentially as the polishing medium bath 20 rotates circumferentially. Any mediums such as ceramics which are usually used, can be used as the polishing mediums 21, 21, . . . The polishing method may be a wet polishing or a dry polishing.

Reference numeral 22 denotes an upper end opening of the polishing medium bath 20. Through this upper end opening 22, a workpiece (vehicle wheel made of aluminum in this embodiment) W is dipped in the polishing mediums 21, 21, . . .

Reference numeral 11 denotes a support frame erected from the base 10. This support frame 11 extends approximately so far as an upper end of the polishing medium bath 20.

Figure 5:
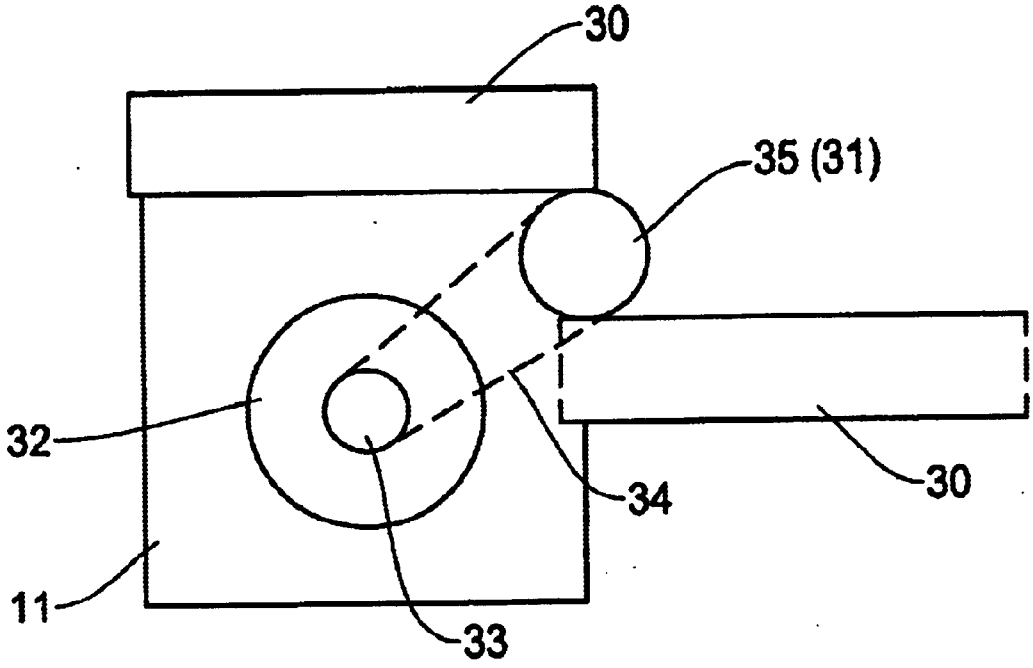

Reference numeral 30 denotes an inverting plate. This inverting plate 30 is placed on the support frame through a rotary shaft 31. The inverting plate 30 rotates within a range of approximately 180 degrees (from the state of FIG. 1 to the state of FIG. 2) as the rotary shaft 31 rotates. Also, as shown in FIG. 5, a first drive motor 32 is disposed on the support frame 11. A rotational force of the motor 32 is transmitted from a pulley 33 to a pulley 35 of the rotary shaft 31 through a V-belt 34 in its decelerated state, so that the inverting plate 30 can reciprocally be inverted within a range of 180 degrees.

Figure 3:
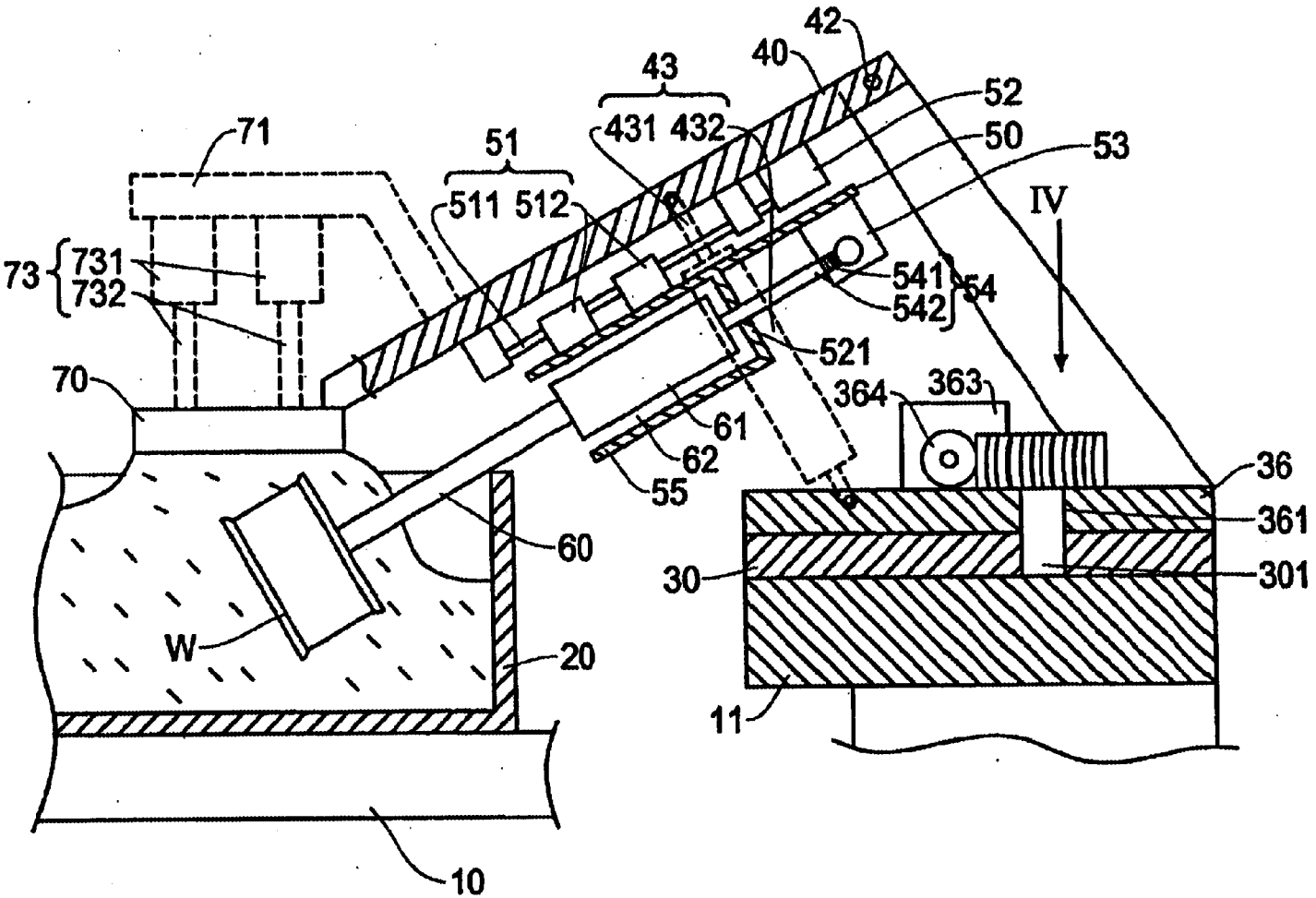

In FIG. 3, reference numeral 301 denotes a pivot pin applied to the inverting plate 30 and partly projecting upwardly. The function of this pivot pin 301 will be described hereinafter.

Reference numeral 36 denotes a turnable plate. This turnable plate 36 is placed on an upper surface of the inverting plate 30 in superimposed relation. As shown in FIG. 3, the turnable plate 36 has a through hole 361 (see FIG. 3). The pivot pin 301 is loosely fitted in the through hole 361. This makes it possible for the turnable plate 36 to turn about the pivot pin 301. Reference numeral 362 denotes a worm wheel. This worm wheel 362 is mounted on a projected portion of the pivot pin 301.

Figure 4:
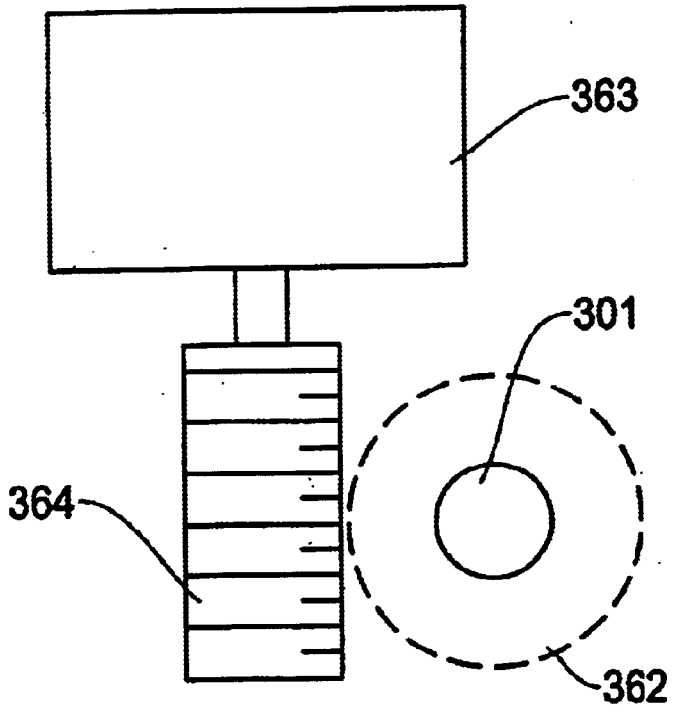

Referring again to FIG. 3, reference numeral 363 denotes a fourth drive motor. This fourth drive motor 363 is fixedly mounted on the turnable plate 36. As shown in FIGS. 3 and 4, reference numeral 364 denotes a worm gear connected to a rotational pin of the fourth drive motor 363. Since the worm gear 364 is in engagement with the worm wheel 362, the turnable plate 36 on which the fourth drive motor 363 is fixedly mounted, can turn about the pivot pin 301 when the fourth drive motor 363 is rotated. It should be noted that although the worm gear 364 and the worm wheel 362 correspond to the "swing means" of the first and second inventions, the swing means of the present invention is by no means limited to the aforementioned worm gear 364 and worm wheel 362 but it includes all existing conventional swing means.

Reference numerals 41, 41 denote one pair of attachment devices which are disposed on opposite rear end portions of the turnable plate 36. The attachment devices 41, 41 extend upwardly in generally parallel relation. Reference numeral 40 denotes a support bed. This support bed 40 is turnably mounted on distal end portions of the attachment devices 41, 41 through pins 42, 42. The support bed 40 is normally held in its forwardly slanted state (the forward end side of a workpiece support arm 60 as later described is herein referred the forward direction). Reference 43 denotes a piston cylinder mechanism disposed between the support bed 40 and the turnable plate 36. This piston cylinder mechanism 43 comprises a piston rod 431 disposed on the support bed 40 and a cylinder 432 disposed on the turnable plate 36. The piston cylinder mechanism 43 is reciprocally operated by air pressure or hydraulic pressure, thereby enabling to swing the support bed 40 relative to the turnable bed 36 such that the support bed 40 is stopped in any desired place.

As shown in FIG. 3, a slider 50 is reciprocally movably disposed on a lower surface of the support bed 40 along the slanting direction of the support bed 40. This slider 50 can reciprocally move relative to the support bed 40 by a bolt nut mechanism (this bolt nut mechanism corresponds to the "reciprocal means" of the first and second inventions) 51. Reference numeral 511 denotes a bolt portion of the bolt nut mechanism 51 disposed on the lower surface of the support bed 40 and reference numerals 512, 512 denote nut portions of the bolt nut mechanism 51 disposed on the slider 50. When a second drive motor 52 is driven to turn the bolt portion 511, the nut portion 511 and thus the slider 50 are reciprocally moved along an axial direction of the bolt portion 511 in response to the threading motion of the bolt potion 511. The aforementioned "reciprocal means" includes not only the bolt nut mechanism 51 but also all existing conventional reciprocal means.

Reference numeral 55 denotes a motor installation chamber which is defined in the slider 50. Reference numeral 521 denotes a through hole which is formed in a rear wall of the motor installation chamber 55. The functions of the motor installation chamber 55 and the through hole 521 will be described hereinafter.

Reference numeral 61 denotes a third drive motor. This third drive motor 61 is fitted to the motor installation chamber 55 through a resilient material (spring, rubber, etc.). Owing to this feature, the third drive motor 61 can swingingly move upwardly and downwardly, leftwardly and rightwardly in the motor installation chamber 55.

Reference numeral 60 denotes a workpiece support arm. This workpiece support arm 60 is connected to the third drive motor 61 in its rotational force reduced state. A workpiece (aluminum vehicle wheel) W is removably attached to a distal end of the workpiece support arm 60 through an air chuck and dipped in the polishing mediums 21, 21, . . . of the polishing medium bath 20. Thus, in response to the rotation of the third drive motor 61, the workpiece support arm 60 rotates about its own axis. It should be noted here that the workpiece support arm 60 can also intermittently rotate normally and backwardly.

Reference numeral 53 denotes a fifth drive motor. This fifth drive motor 53 is disposed at a backward location in the motor installation chamber 55 of the slider 50. This fifth drive motor 53 is connected to a rear end portion of the third drive motor 61 through a crank mechanism (this crank mechanism corresponds to the "vibration means" of the first and second inventions) 54 to apply micro-vibrations to the third drive motor 61. The crank mechanism 54 comprises a crank arm 541 connected to the fifth drive motor 53 and a crank rod 542 rackably connected to the crank arm 541 and the third drive motor 61. Reference numeral 70 denotes a pressing plate integrally formed on the distal end of the support bed 40. This pressing plate 70 is adapted to prevent the polishing mediums 21, 21, . . . from bulging when the workpiece W is being polished in the polishing mediums 21, 21, . . .

Figure 6:
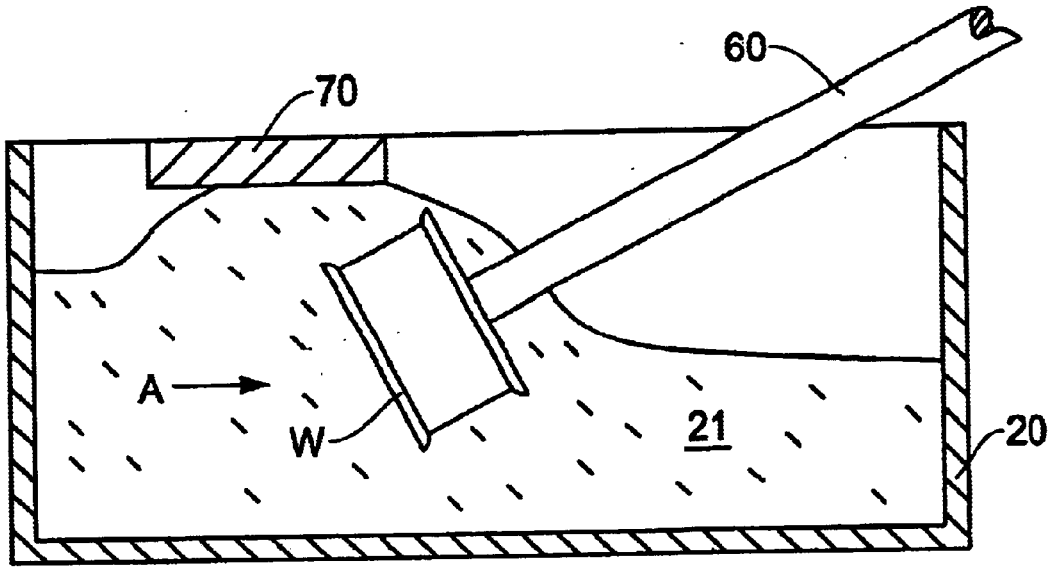
Figure 7:
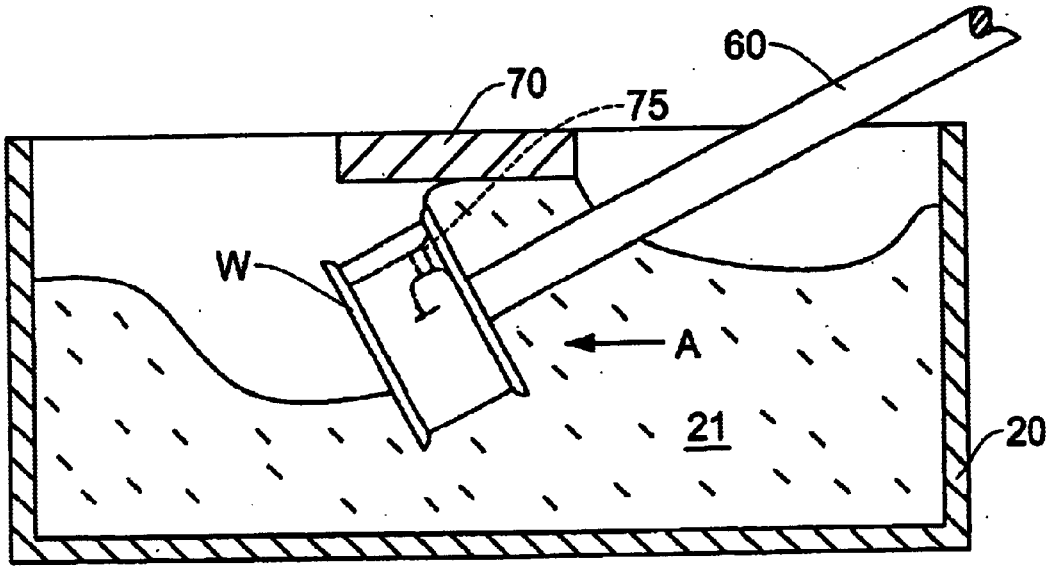

In case the workpiece W is placed with its surface to be polished slanted forwardly upwardly (see FIG. 6) with respect to the flowing direction (as indicated by an arrow A) of the polishing mediums 21, 21, . . . , the pressing plate 70 is disposed on that place of the polishing mediums 21, 21, . . . located forwardly of the workpiece W where the polishing mediums 21, 21, . . . are readily bulged. On the other hand, in case the workpiece W is placed with its surface to be polished slanted forwardly downwardly (see FIG. 7) with respect to the flowing direction (as indicated by an arrow A) of the polishing mediums 21, 21, . . . , the pressing plate 70 is disposed on that place of the polishing mediums 21, 21, . . . located generally upwardly of the workpiece W where the polishing mediums 21, 21, . . . are readily bulged. In case of a workpiece W having a so-called through hole (this through hole corresponds to the "window portion" of the first and second inventions) 75 such as a vehicle wheel having a window portion, the state of FIG. 7 is more preferred because the polishing mediums 21, 21, . . . pass through the through hole 75 and the flow thereof becomes smoother. As a consequence, the polishing effect is enhanced.

If, as indicated by an imaginary line, a support device 71 is mounted on the support bed 40, the pressing plate 70 and the support bed 40 are separately provided, and the pressing plate 70 is mounted on the support bed 40 through piston cylinder mechanisms (the piston cylinder mechanisms correspond to the "pressing means" of the first and second inventions) 73, 73, the pressing force of the pressing plate 70 can be appropriately adjusted in accordance with the operation of the piston cylinder mechanisms 73, 73. Each piston cylinder mechanism 73 comprises a cylinder 731 and a piston rod 732 and is reciprocally moved by air pressure or hydraulic pressure. Also, by dividing the pressing plate 70 into a plurality of auxiliary pressing plates and adjusting a pressing state of each of the auxiliary pressing plates by the piston cylinder mechanism 73 or the like, the surface pressure of the polishing mediums 21, 21, . . . applicable to the workpiece W can partly be adjusted. Also, by forming a window or the like in the pressing plate 70, the surface pressure of the polishing medium 21 applicable to the workpiece W can be adjusted. The pressing means includes not only this piston cylinder mechanism 73 but also all existing conventional pressing means.

Figure 8:
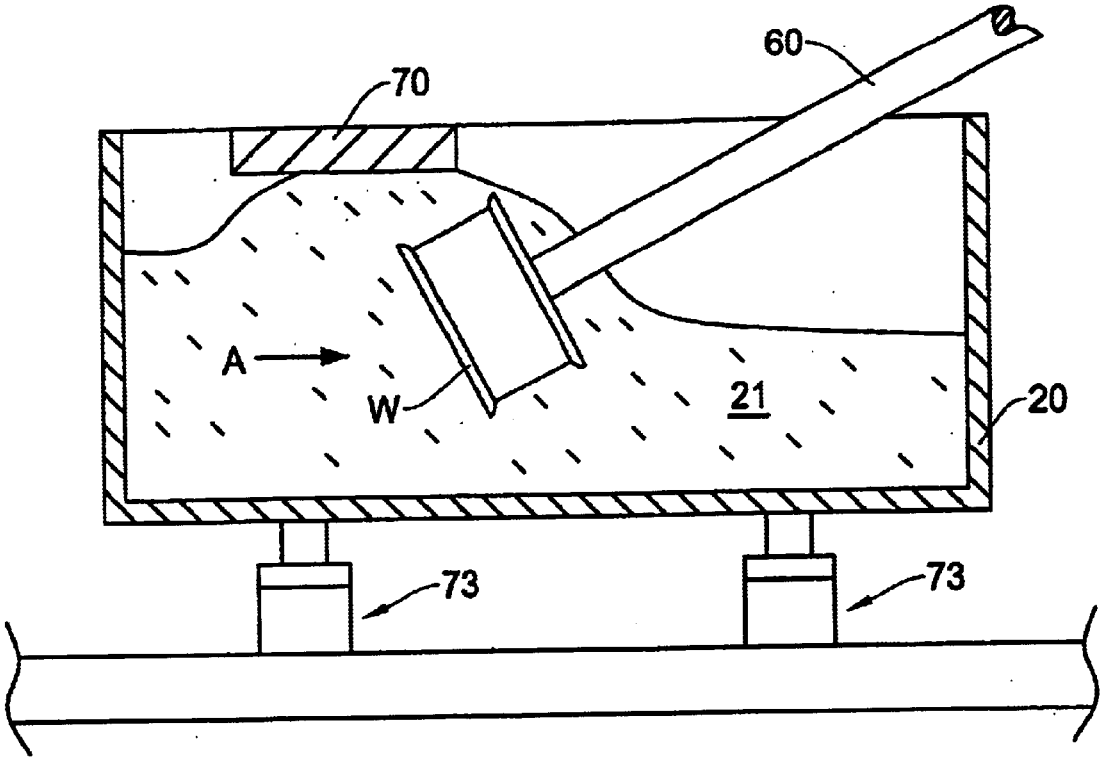

On the other hand, as shown in FIG. 8, by reciprocally moving the polishing medium bath 20 towards an upper portion (opening 22 side) of the polishing medium bath 20 by an appropriate reciprocal means (piston cylinder mechanism, or the like) 73 with the pressing plate 70 fixed, the surface pressure of the polishing mediums 21, 21, . . . applicable to the workpiece W can be adjusted.

Attaching/detaching operation of the workpiece W in this polishing apparatus will now be described briefly.

First, as shown in FIG. 2, the first drive motor 32 is driven to rotate the rotary shaft 31 so that the inverting plate 30 is brought to an outer side of the polishing medium bath 20 (see the state indicated by an imaginary line of FIG. 5). At that time, the distal end of the workpiece support arm 60 is oriented slantwise upwardly. In that state, the operator fixedly attaches the vehicle wheel W to the distal end of the workpiece support arm 60.

Thereafter, as shown in FIG. 1, the first drive motor 32 is driven to rotate the rotary shaft 31 backwardly so that the inverting plate 30 is brought to an inner side of the polishing medium bath 20 and then, the vehicle wheel W is dipped into the flowing polishing mediums 21, 21, . . . in the polishing medium bath 20. After the completion of polishing operation, the first drive motor 32 is driven to rotate the rotary shaft 31 so that the inverting plate 30 is brought to an outer side of the polishing medium bath 20. At that time, the distal end of the workpiece support arm 60 is oriented slantwise upwardly. In that state, the operator detaches the vehicle wheel W from the workpiece support arm 60 and fixedly attach the next workpiece.

Figure 9:
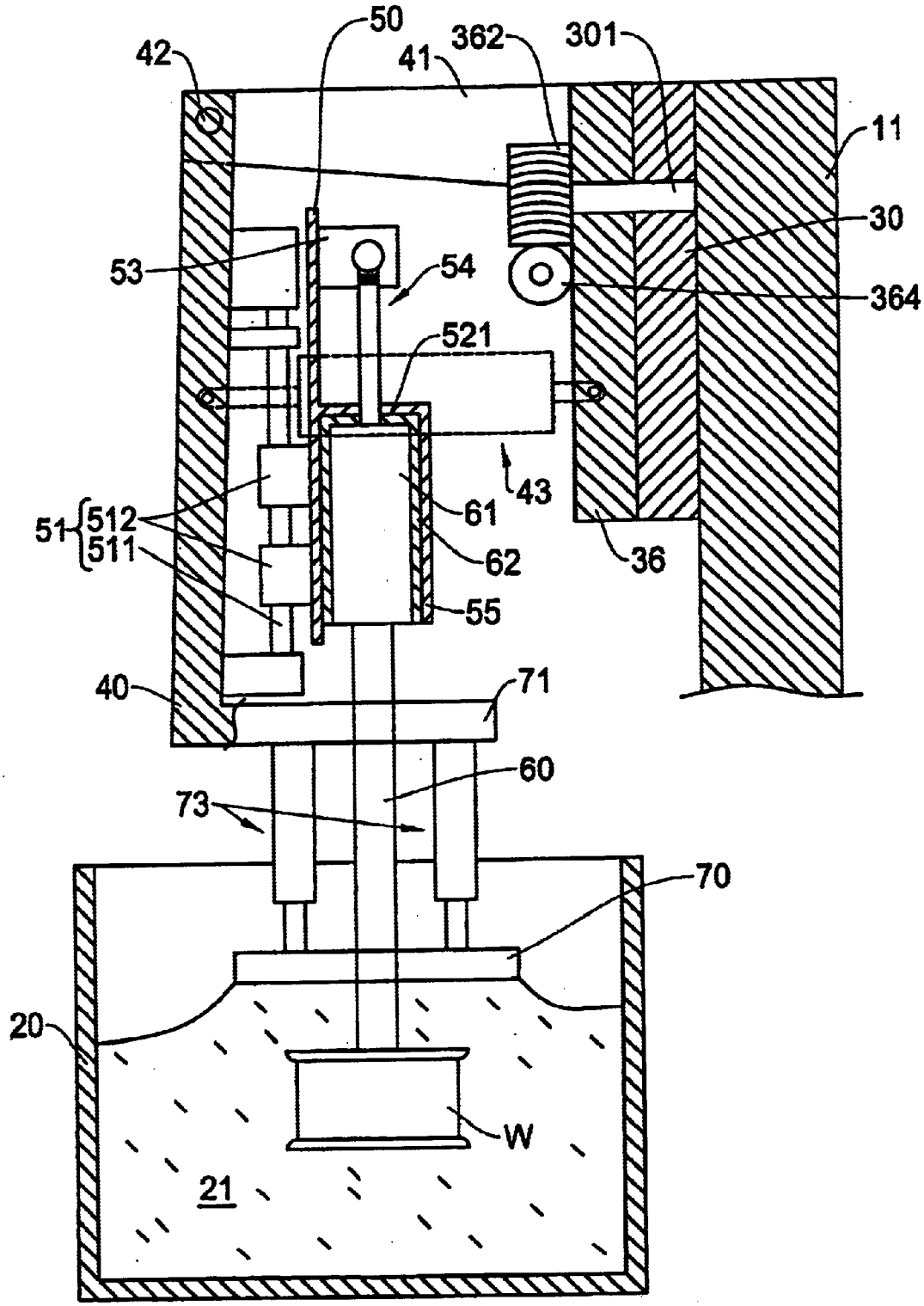

FIG. 9 shows another embodiment in which the work support arm 60 is mounted such that the surface-to-be-polished of the workpiece W is in generally parallel relation to the bottom wall surface of the polishing medium bath 20.

One example of acceptable polishing mediums includes soft material in the form of particles, lumps, or the like, such as sponge, rubber, soft plastic, etc. By using one of those materials, the finish polishing can be performed efficiently. It should be noted that the polishing mediums of this type may be obtained by coating a soft material on the surface of hard particles, hard lumps, or the like.

After barrel polishing, the workpiece is then subjected to surface treatment such as coating, plating, alumiting, etc. This surface treatment may be any of the existing techniques usually put into practice.

(Embodiments of the Third to Fifth Inventions)

Description of those portions in common with the first and second inventions is omitted.

Figure 10:
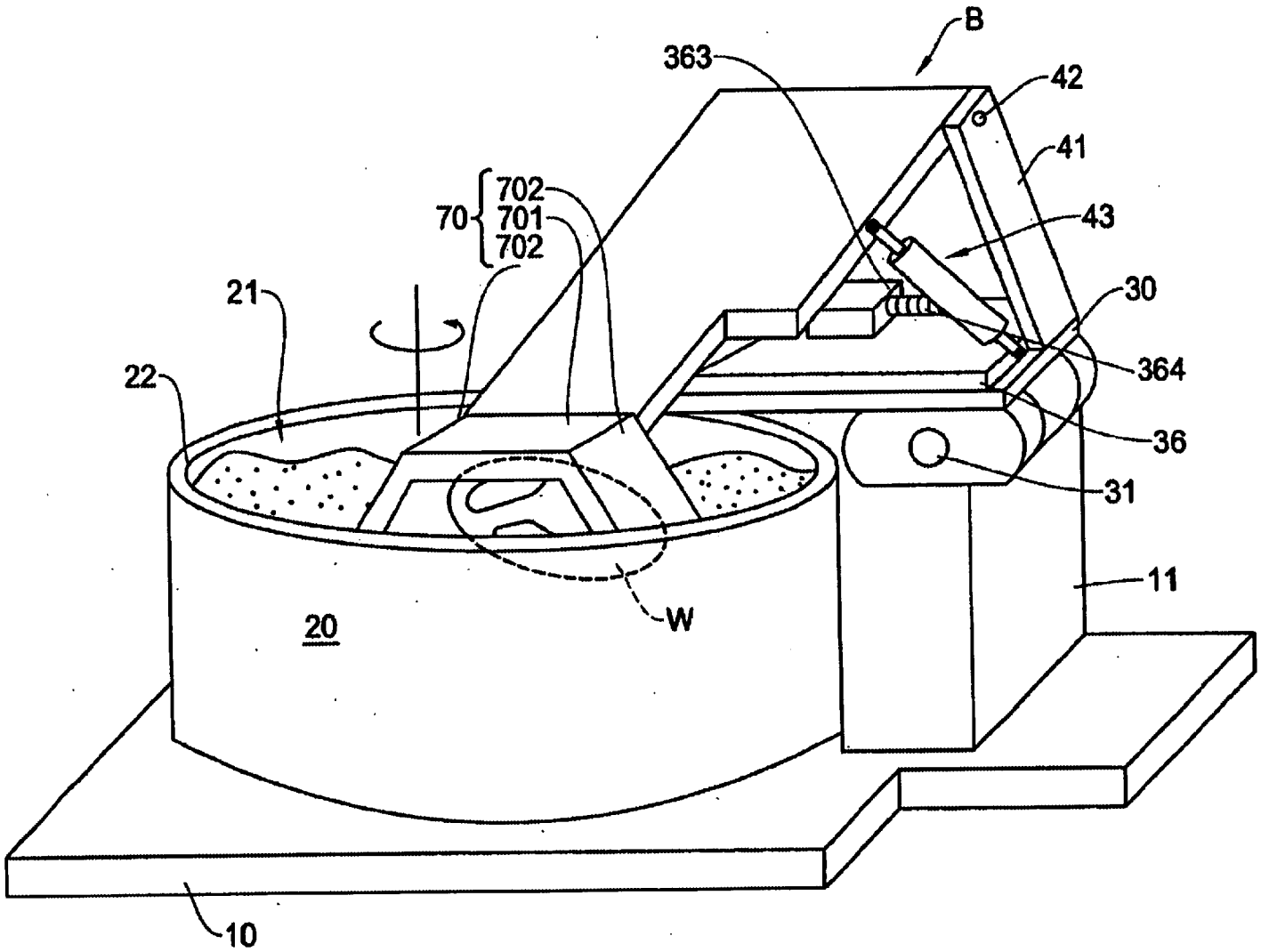
Figure 11:
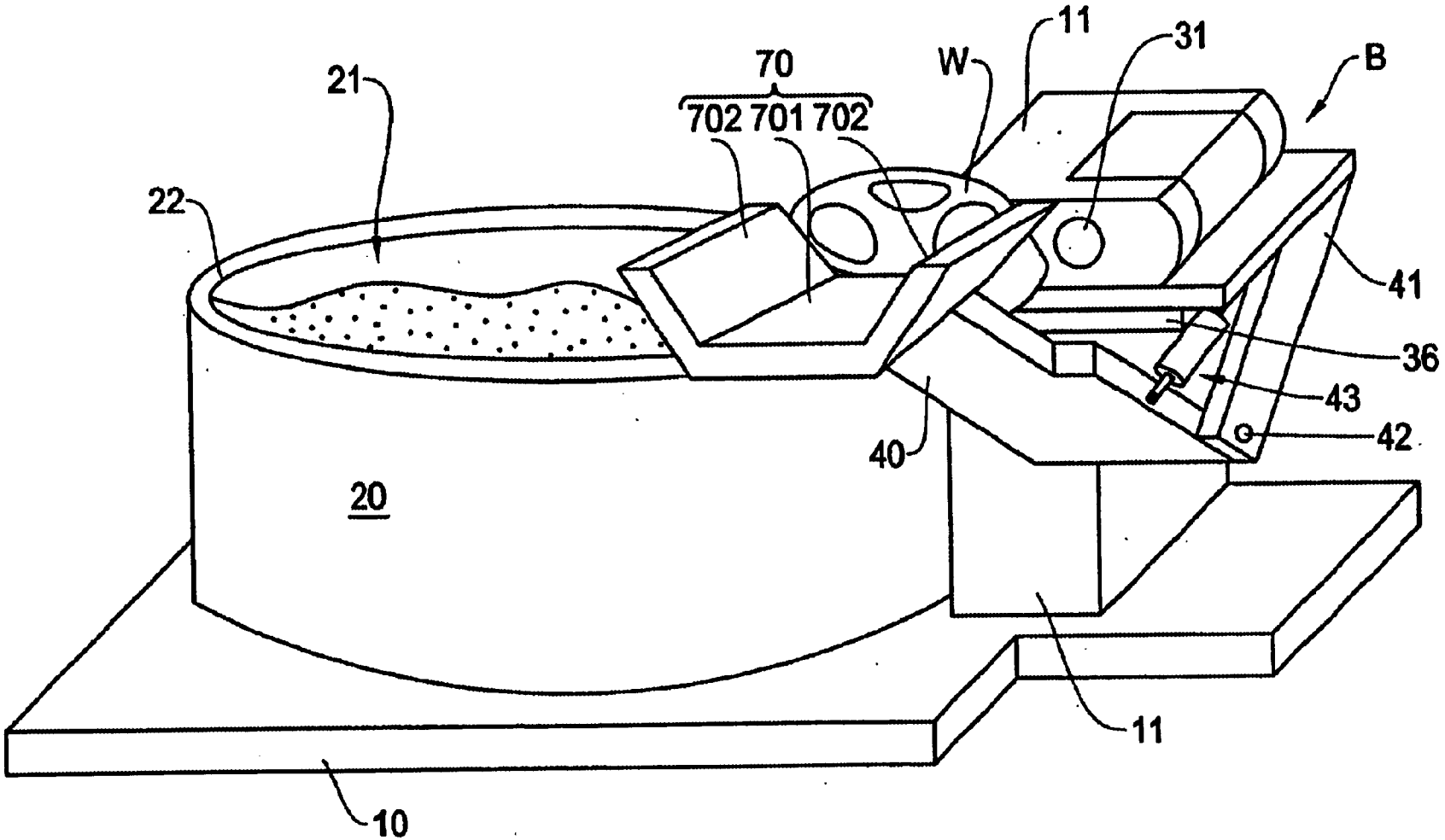
Figure 12:
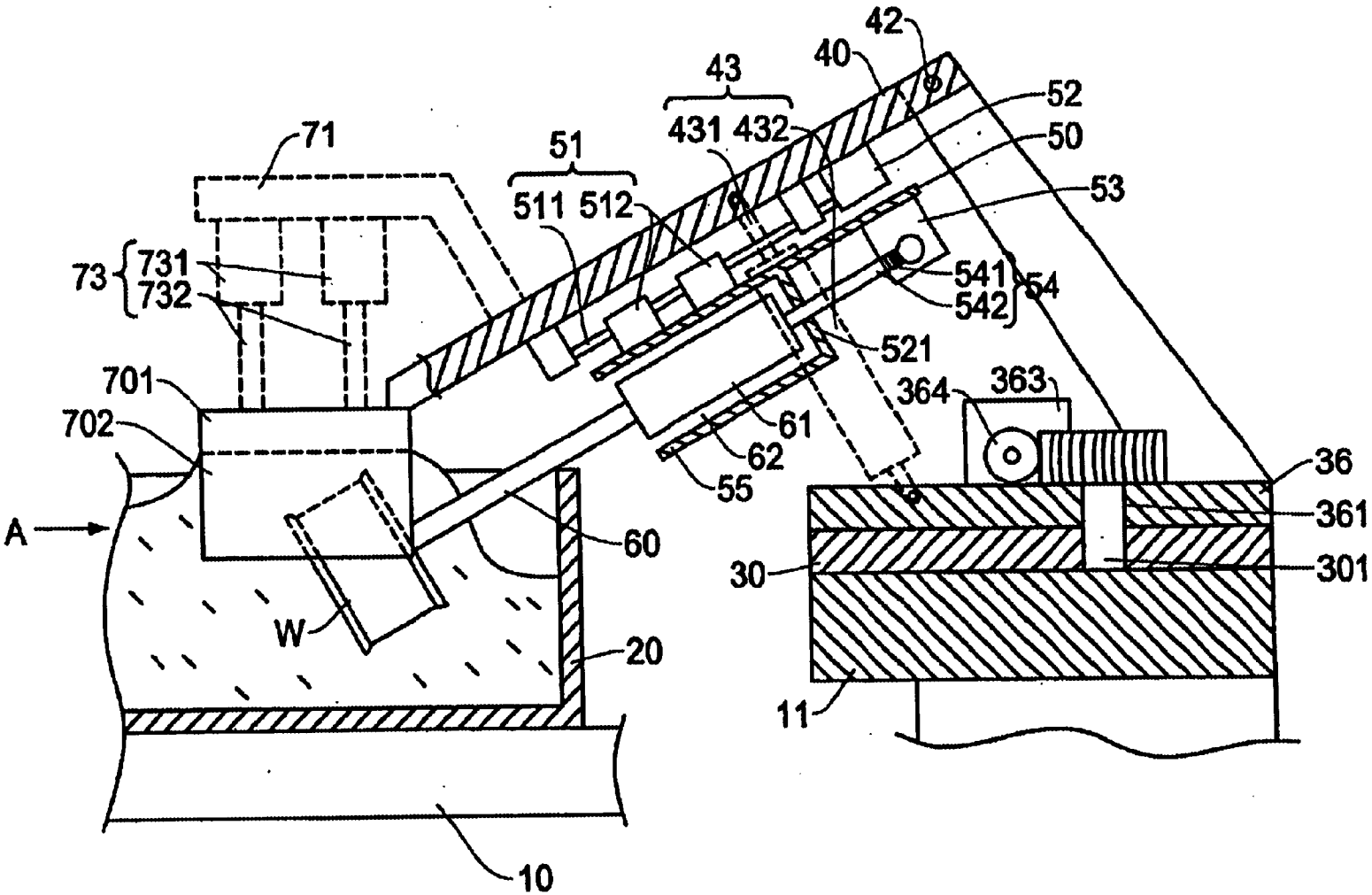
Figure 15:
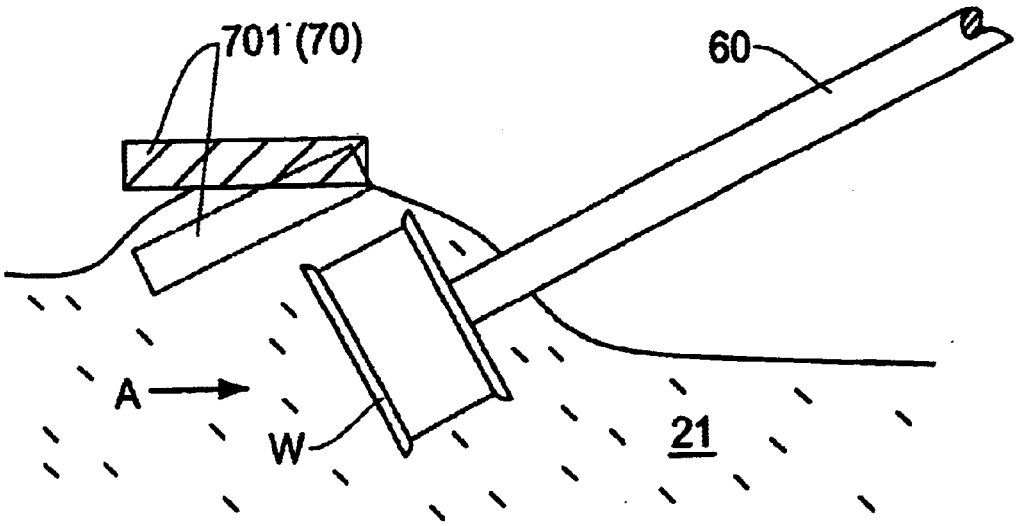

As shown in FIGS. 10 and 11, the pressing plate 70 employed in this embodiment comprises auxiliary plates 702, 702 connected to opposite end edges of a horizontal plate 701, thus exhibiting a generally horizontal U-shaped configuration (namely, a configuration gradually open towards its distal end). The inner side surrounded by the horizontal plate 701 and one pair of the auxiliary plates 702, 702 corresponds to the recess of the present invention. The pressing plate 70 may exhibit a V-shaped configuration or a U-shaped configuration in section. The pressing plate 70 is placed such that the recess surrounds an upper portion of the workpiece W with an appropriate space therebetween (see FIG. 12). The horizontal plate 701 may be placed in parallel relation to the relatively flowing direction, as indicated by an arrow A of FIG. 15, of the polishing mediums 12, 12, . . . so that the forward of the workpiece W is spread, or it may be placed in parallel with the axis of the workpiece (vehicle wheel) W as indicated by an imaginary line of FIG. 15.

Figure 13:
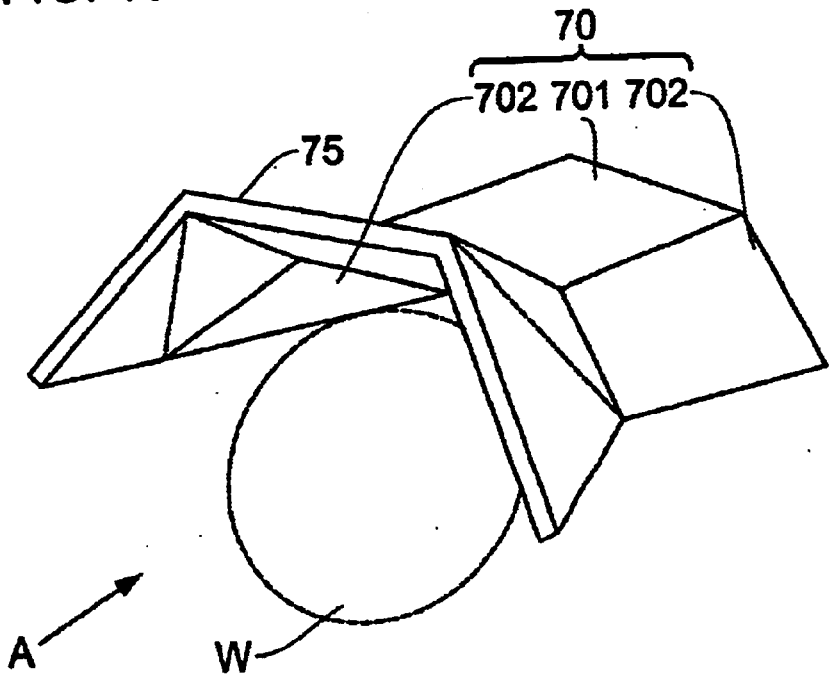

FIG. 13 shows an improvement of the pressing plate 70 described above. In the illustration, reference numeral 75 denotes a guide plate. As shown on FIG. 13, this guide plate 75 is connected to that end edge of the pressing plate 70 located on the upstream side of the relative flow of the polishing mediums 21. The guide plate 75 is slanted in an opposite direction to the workpiece W towards the upstream of the relative flow of the polishing medium 21. In other words, the guide plate 75 is gradually dilated towards the upstream of the relative flow of the polishing medium 21. This guide plate 75 may be designed such that its width is gradually reduced towards the opposite end edges (lower end edges of the auxiliary plates 702, 702) of the pressing plate 70 as indicated by an imaginary line of FIG. 13. In this way, since the aggregate of the polishing mediums 21, 21, . . . can be gradually reduced towards the opposite end edges (lower end edges of the auxiliary plates 702, 702) of the pressing plate 70, the surface pressure applicable to the entire workpiece W can be adjusted so as to be uniform in relation to the depth of the polishing mediums 21, 21, . . .

Figure 14:
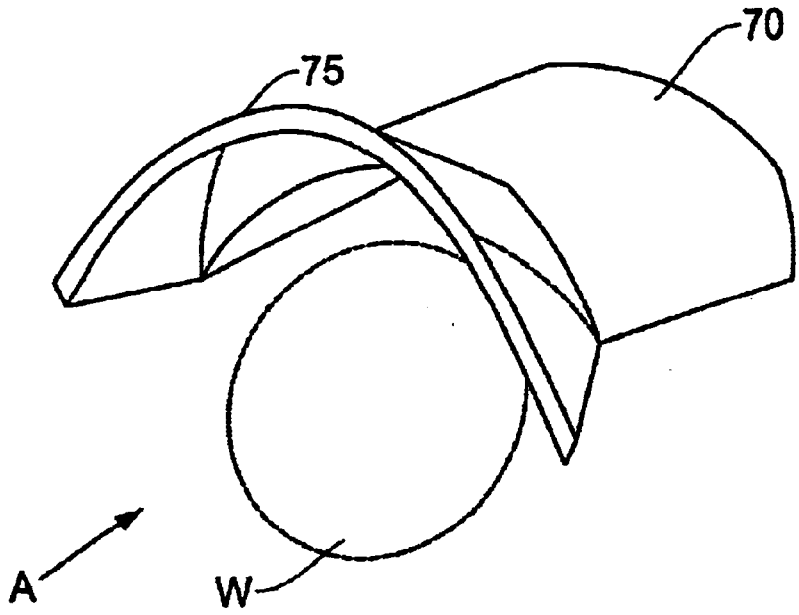

FIG. 14 shows another example of an improved pressing plate 70. The pressing plate 70 of this example exhibits a generally U-shaped configuration in section. If the pressing plate 70 is designed in this way, in case the workpiece W has a disc-like configuration such as a vehicle wheel or the like, a predetermined interval between the pressing plate 70 and the workpiece W can easily be obtained. In FIGS. 13 and 14, the arrow a shows the direction of the relative flow of the polishing mediums 21, 21, . . .

In the present invention, the expression "relative flow of the polishing mediums" refer to (1) the polishing mediums 21 flow while the workpiece W is stationary, (2) the workpiece W is moved while the polishing mediums 21 are stationary, and (3) the polishing mediums 21 are moved in opposing relation.

Figure 16:
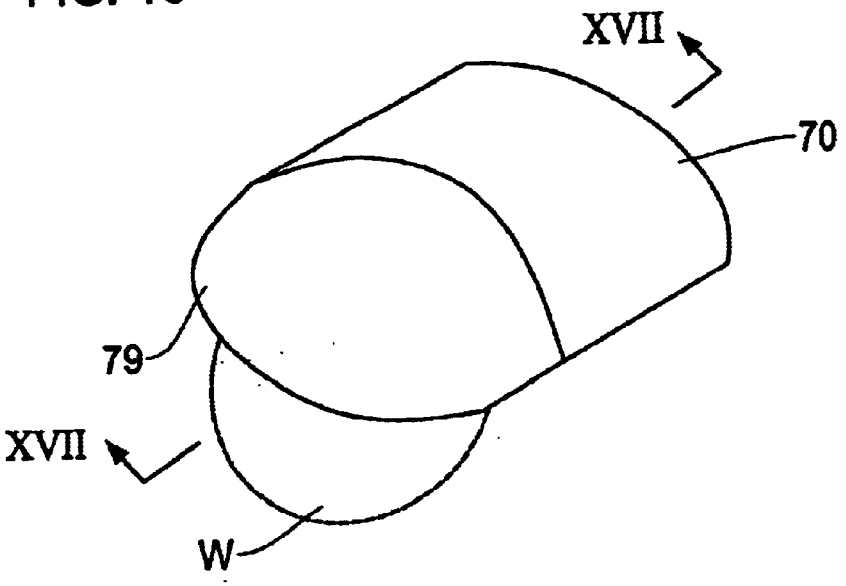
Figure 17:
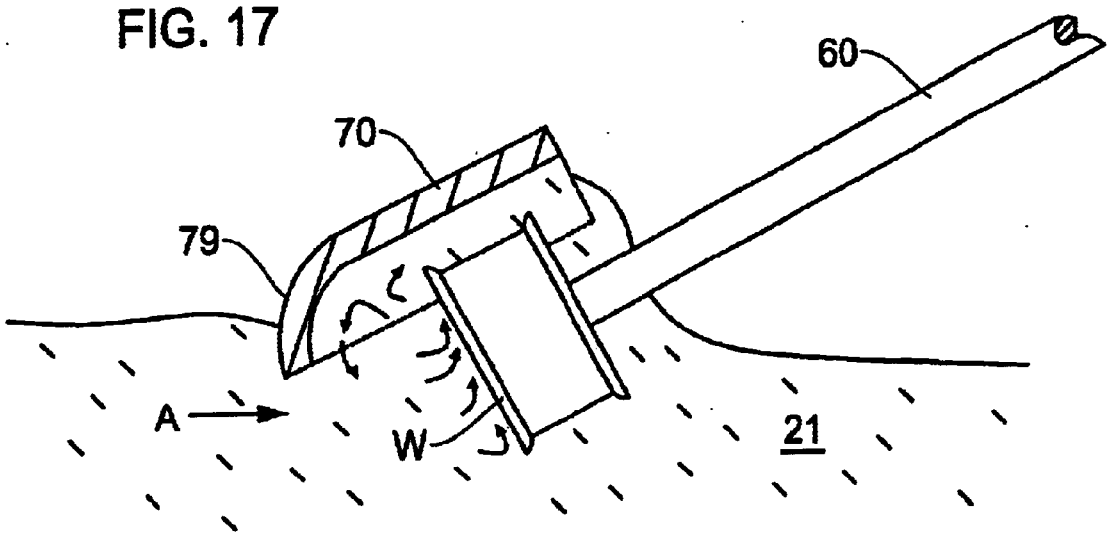

FIGS. 16 and 17 show another example in which a semi-dome like baffle plate 79 is connected to a distal end side of the pressing plate 70. Owing to this arrangement, the polishing mediums 21, 21, . . . collided against and raised along the surface-to-be-polished of the workpiece W invade into the inner side of the baffle plate 79 and cause a turbulent flow involving the vicinity of the surface-to-be-polished of the workpiece W. This serves to enhance the polishing efficiency with respect to the workpiece W. It should be noted that the configuration of the baffle plate 79 is by no means limited to the semi-dome like configuration but it can be any one of numerous configurations which can prevent the flow of the polishing mediums 21, 21, . . . and cause a turbulent flow.

The attaching/detaching operation of the workpiece W and the method to carry out the polishing operation in this polishing apparatus will now be described briefly.

First, as shown in FIG. 11, the first drive motor 32 is driven to rotate the rotary shaft 31 so that the inverting plate 30 is brought to an outer side of the polishing medium bath 20 (see the state indicated by an imaginary line of FIG. 5). At that time, the distal end of the workpiece support arm 60 is oriented slantwise upwardly. In that state, the operator fixedly attaches the vehicle wheel W to the distal end of the workpiece support arm 60.

Thereafter, as shown in FIG. 10, the first drive motor 32 is driven to rotate the rotary shaft 31 backwardly so that the inverting plate 30 is brought to an inner side of the polishing medium bath 20 and then, the vehicle wheel W is dipped into the flowing polishing mediums 21, 21, . . . in the polishing medium bath 20. At that time, the polishing mediums 21, 21, . . . , which are prevented from escaping by the pressing plate 70, can rub the workpiece W.

The flowing of the polishing mediums 21, 21, . . . relative to the workpiece W is reduced (or stopped) at the first or last stage of a polishing operation so that the polishing mediums 21, 21, . . . will primarily stay at the axial portion of the workpiece W. By doing so, the axial portion of the workpiece W can be polished efficiently and positively.

After the completion of polishing operation, the first drive motor 32 is driven to rotate the rotary shaft 31 so that the inverting plate 30 is brought to an outer side of the polishing medium bath 20. At that time, the distal end of the workpiece support arm 60 is oriented slantwise upwardly. In that state, the operator detaches the vehicle wheel W from the workpiece support arm 60 and fixedly attach the next workpiece.

(Embodiments of the Sixth and Seventh Inventions)

Figure 18:
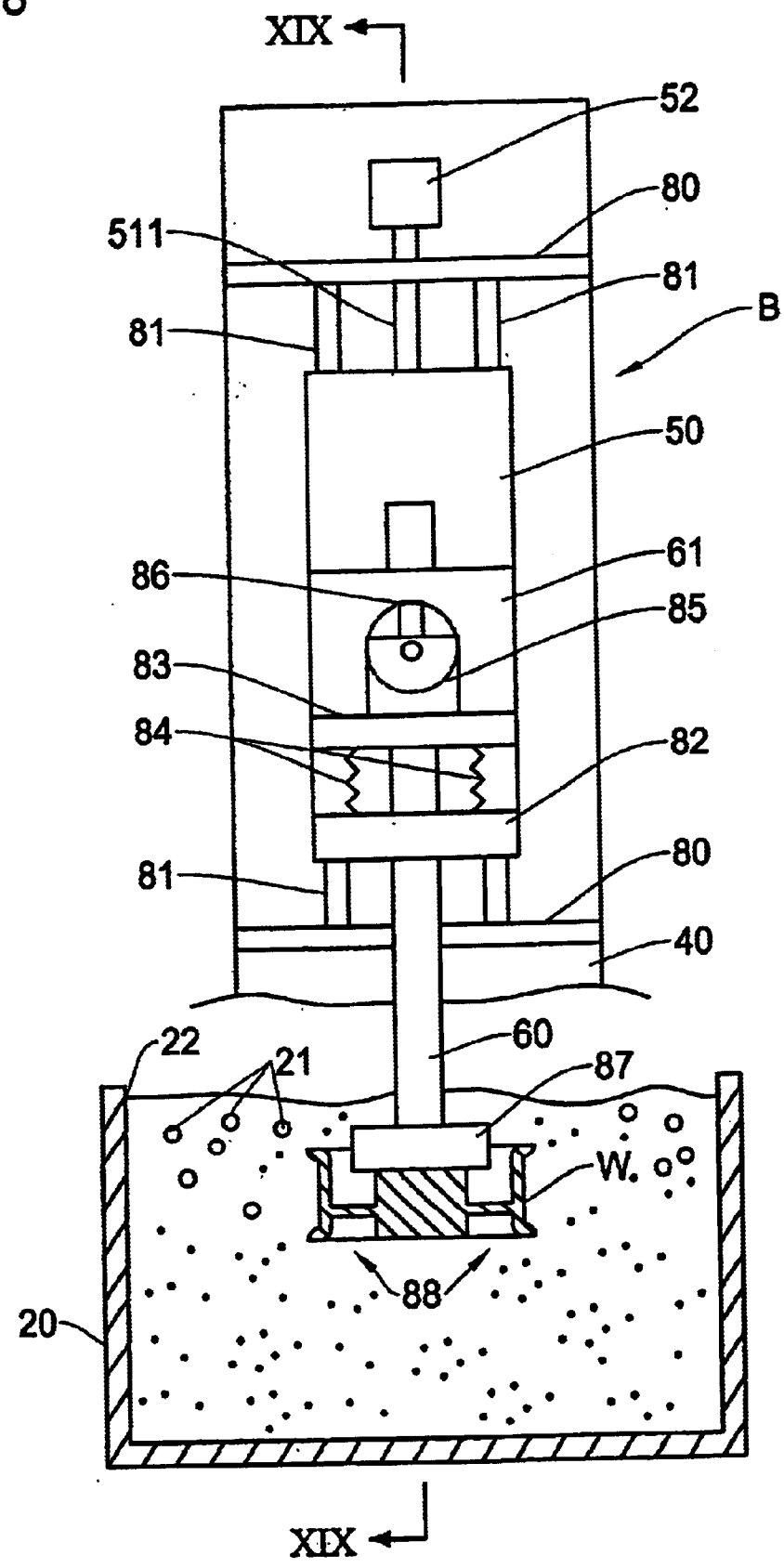
Figure 19:
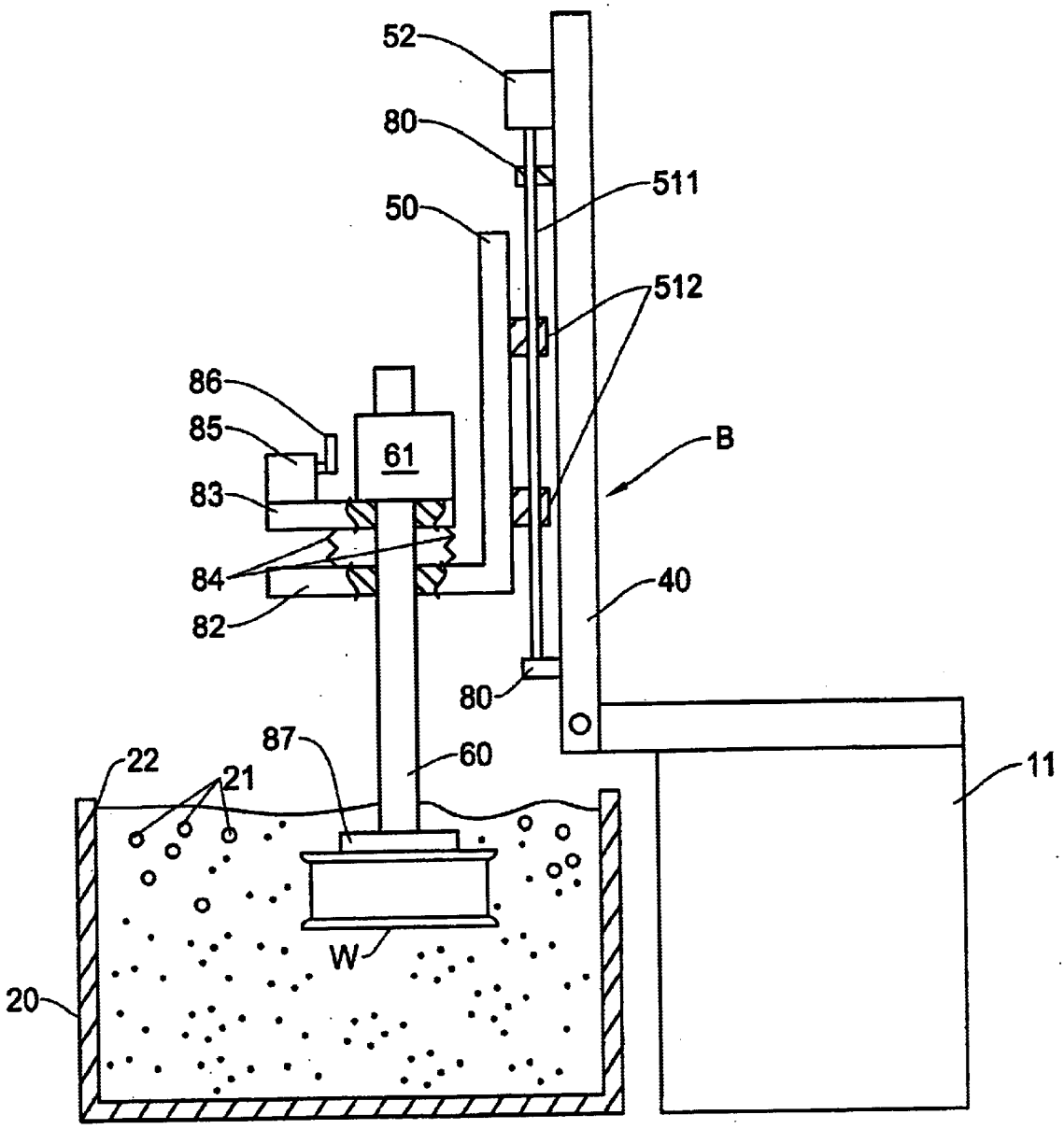
Figure 20:
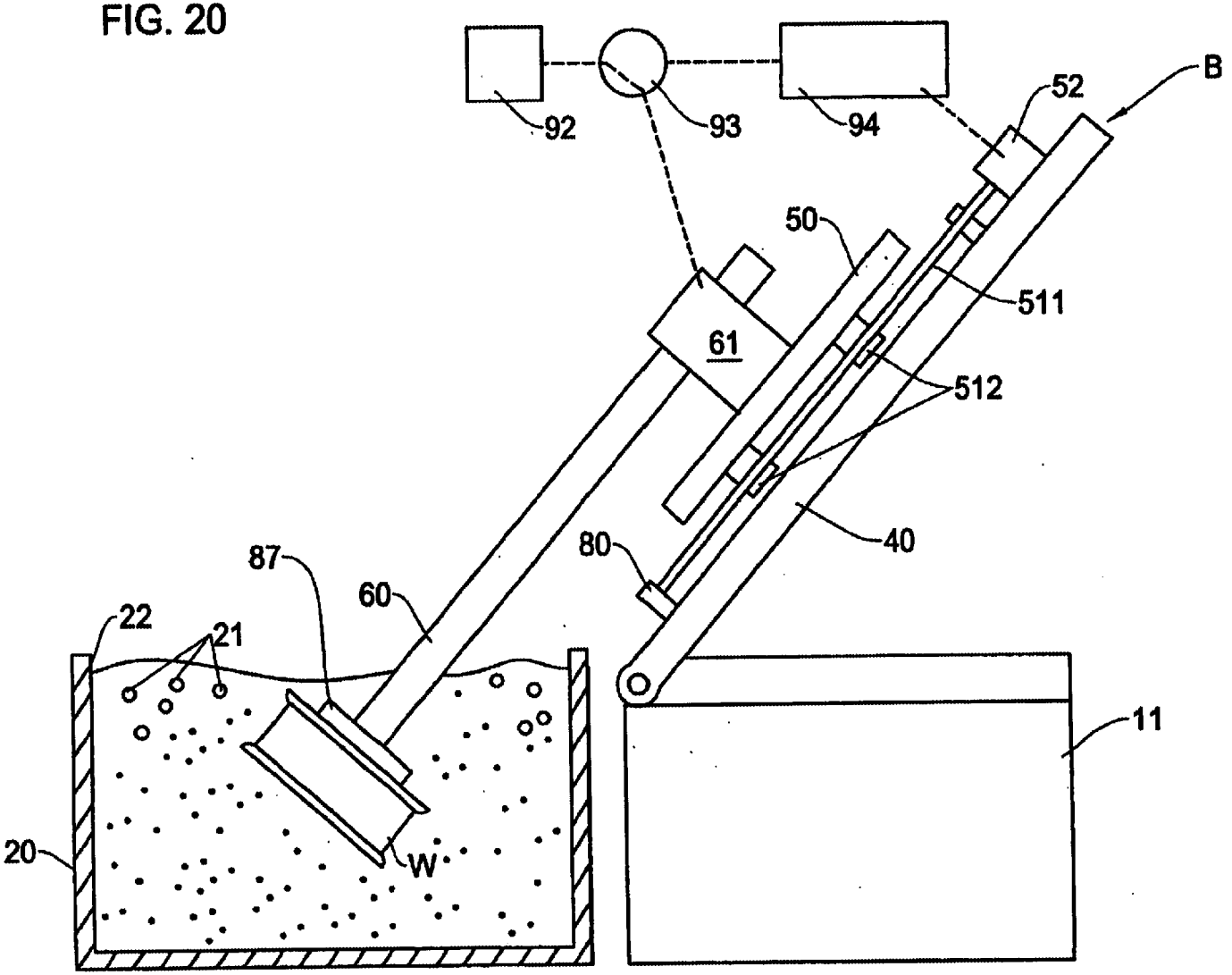
FIG. 20 is a sectional view of a barrel-polishing apparatus, showing an embodiment of the eighth invention.

In FIGS. 18 and 19, reference character B denotes a barrel-polishing apparatus. This barrel-polishing apparatus B includes a cylindrical polishing medium bath 20. Reference numerals 21, 21, . . . denote polishing mediums which are received in the polishing medium bath 20. Any mediums such as ceramic particles which are usually used, can be used as the polishing mediums 21, 21, . . . The polishing method may be a wet polishing or a dry polishing.

Reference numeral 22 denotes an upper end opening of the polishing medium bath 20. Through this upper end opening 22, a workpiece (vehicle wheel made of aluminum in this embodiment) W is dipped in the polishing mediums 21, 21, . . .

On the other hand, reference numeral 11 denotes a support bed of the barrel-polishing apparatus B and reference numeral 40 denotes a base (this base corresponds to the "base" of the sixth and seventh inventions) swingably mounted on this support bed 11. This base 40 is slanted downwardly in a direction of the polishing medium bath 20. This slanting angle can appropriately be adjusted. The base 40 can stop at an appropriate angle. Reference numeral 52 denotes a geared engine mounted on the base 40, and reference numeral 511 denotes a bolt member connected to the geared engine 52. This bolt member 511 is rotatably supported by one pair of bearings 80, 80 such that it can rotate normally and backwardly about its axis in accordance with rotation of the geared engine 52. This bolt member 51 is disposed along the slanted direction of the base 40. Reference numerals 81, 81 denote guide members. The guide members 81, 81 are disposed between the paired bearings 80, 80. Operation of the guide members 81, 81 will be described hereinafter.

Reference numeral 50 denotes a slide plate, and reference numerals 512, 512 denote nut members projecting from a lower surface of this slide plate 50. The slide plate 50 is slidably fitted to the guide members 81, 81, and the nut members 512, 512 are threadingly engaged with the bolt member 511 of the base 40. Owing to this arrangement, the slide plate 50 can reciprocally slide in accordance with rotation of the bolt member 511. The bolt member 511, the nut member 512 and the geared engine 52 correspond to the "reciprocal means" of the sixth and seventh inventions.

Reference numeral 82 denotes a shelf portion. This shelf portion 82 is integral with a front end edge of the slide plate 50 and projects in a perpendicular direction with respect to the slide plate 50. Reference numeral 83 denotes a support plate which is mounted on the shelf portion 82 through springs 84, 84. This support plate 83 can reciprocally move in the forward and backward directions and swing leftwardly and rightwardly under the effects of the springs 84, 84.

Reference numeral 61 denotes a rotational drive portion placed on the support plate 83. This rotational drive portion 61 comprises an engine (AC or DC engine) and a reduction gear unit. The rotational drive portion 61 can provide a rotary motion through a rotary shaft 60. The rotary shaft 60 extends along the axis of the bolt member 51, i.e., in the slanting direction of the base 40.

Reference numeral 85 denotes an engine placed on the support plate 83. A rotary shaft of this engine 85 is faced with the rotary shaft 60 of the rotational drive portion 61. Reference numeral 86 denotes a balance weight mounted on the rotary shaft of the engine 85. Since the balance weight 85 performs a circular motion (see the imaginary line of FIG. 19) when the engine 85 rotates, the support plate 83 and thus, the rotary shaft 60 are vibrated circularly or forwardly and backwardly, and leftwardly and rightwardly along a surface including the axis of the rotary shaft 60. The engine 85, the balance weight 86, the support plate 83 and the spring 84 correspond to the "vibration means" of the sixth and seventh inventions. The engine 85 may be provided with a reduction gear unit.

The workpiece (aluminum vehicle wheel) W is attached to a distal end of the rotary shaft 60 through a work attachment device (an air chuck) 87 and dipped in the polishing mediums 21, 21, . . . of the polishing medium bath 20. Then, the rotational drive portion 61 is actuated to rotate the rotary shaft 60 and thus the workpiece W in the polishing mediums 21, 21, . . . At the same time, the engine 85 is actuated to cause the rotary shaft 60 to vibrate circularly or forwardly and backwardly, and leftwardly and rightwardly along a plane including its axis. By doing so, the workpiece W can be barrel polished. At that time, since the workpiece W also vibrates circularly or forwardly and backwardly, and leftwardly and rightwardly, the polishing mediums 21, 21, . . . are positively brought into and out of the recesses 88, 88, . . . As a consequence, the recesses 88, 88, . . . can also be polished positively.

In this embodiment, only one example of the vibration means is shown. It should be noted, however, that the vibration means of the present invention is by no means limited to this example but it also includes all existing conventional vibration means.

(Eighth Embodiment)

Description of those portions in common with the embodiments of the sixth and seventh inventions is omitted.

Reference numeral 61 denotes a rotational drive portion (this rotational drive portion corresponds to the "electrically-operated rotary means" of the eighth invention). The rotational drive portion 61 is mounted on the slide plate 50. The rotational drive portion 61 comprises an engine (AC or DC engine) and a reduction gear unit. The rotational drive portion 61 can provide a circular motion through the rotary shaft 60. The rotary shaft 60 extends along the axis of the bolt member 511, i.e., in the slanting direction of the base 40.

The engine (AC or DC) of the rotational drive portion 61 is driven by a power source 92. At that time, the electric current supplied to the engine is measured by a current detector means 93. The result of measurement thus obtained is sent to a control unit 94 where the result of measurement is compared with a preset value (this preset value corresponds to the "reference electric current" of the eighth invention) and then used as a base for control the operation of the geared engine 52.

The polishing mediums 21, 21, . . . of the polishing medium bath 20 are, in general, less worn towards the lower layer thereof and more worn towards the upper layer because of frequency of use.

The preset value of the control portion 94 is preliminarily established as a current value to be supplied to the engine in relation to a rotary torque required by the engine of the rotational drive portion 60 in consideration of the size of the workpiece W as an object to be polished, configuration of the workpiece W, a required degree of polishing, etc. This preset value is determined based on experience.

Operation of this apparatus will now be described.

First, the preset value is determined in the control portion 94 based on the size, the configuration, etc. of the workpiece W.

In that condition, the power source for the engine of the rotational drive portion 61 is turned on in the state that the workpiece W is dipped in the polishing mediums 21, 21, . . . of the polishing medium bath 20. Then, the rotational drive portion 61 is actuated and the workpiece W is polished in the polishing mediums 21, 21, . . . At that time, the electric current supplied to the engine of the rotational drive portion 61 is measured by the electric current detector means 93. Then, the result of measurement thus obtained is sent to the control unit 94 where the result of measurement is compared with the preset value. When the result of measurement is larger than the preset value, i.e., when the rotary torque is large, the geared engine 52 is actuated to rotate the bolt portion 511, so that the slide plate 50 and thus the rotational drive portion 61 is retracted to bring the workpiece W to an upper layer portion of the polishing mediums 21, 21, . . . and stop it at a position where the value of measurement of the electric current is equal to the preset value. On the other hand, when the value of measurement is smaller than the preset value, i.e., when the rotary torque is small, the geared engine 52 is actuated to rotate the bolt member 511 backwardly to move the slide plate 50 and thus, the rotational drive portion 61 forwardly, so that the workpiece W is brought to a lower layer portion of the polishing mediums 21, 21, . . . and stop it at a position where the value of measurement of the electric current is equal to the preset value.

What is claimed is:

1. A barrel-polishing apparatus comprising a polishing medium bath with polishing mediums received therein, a base, rotational drive means mounted on said base, a rotary shaft mounted on said rotational drive means, and a workpiece attachment device mounted on a distal end portion of said rotary shaft to attach a workpiece to said rotary shaft, wherein said barrel-polishing apparatus further comprises vibration means, and said rotary shaft is circularly vibrated by said vibration means relative to an axis of said rotary shaft.

2. A barrel-polishing apparatus according to claim 1, wherein a slide plate is mounted on said base such that said slide plate is reciprocally moved in a direction of said polishing medium bath by reciprocal means and said rotational drive means is mounted on said slide plate.

3. A barrel-polishing apparatus comprising a polishing medium bath with polishing mediums received therein, a base, rotational drive means mounted on said base, a rotary shaft mounted on said rotational drive means, and a workpiece attachment device mounted on a distal end portion of said rotary shaft to attach a workpiece to said rotary shaft, wherein said barrel-polishing apparatus further comprises vibration means, and said rotary shaft is vibrated in a longitudinal direction of an axis of said rotary shaft or a transversal direction thereof by said vibration means.

4. A barrel-polishing apparatus comprising a polishing medium bath with polishing mediums received therein, a base, a slide plate mounted on said base such that said slide plate is reciprocally moved in a direction of said polishing medium bath by reciprocal means, an electrically-operated rotational drive means mounted on said slide plate, a rotary shaft mounted on said electrically-operated rotational drive means and extending in a direction of reciprocal movement of said slide plate, and a workpiece attachment device mounted on a distal end portion of said rotary shaft to attach a workpiece to said rotary shaft, wherein said barrel-polishing apparatus further comprises a control unit for controlling a reciprocal movement of said reciprocal means by detecting an electric current supplied to said electrically-operated rotational drive means.

5. A barrel-polishing apparatus according to claim 4, wherein said slide plate is moved towards said polishing medium bath when the electric current supplied to said electrically-operated rotational drive means is smaller than a reference electric current and said slide plate is moved away from said polishing medium bath when the electric current supplied to said electrically-operated rotational drive means is larger than said reference electric current.

6. A barrel-polishing apparatus according to claim 4, wherein said base is slanted downwardly towards said polishing medium bath.

* * * * *